US006226971B1

(12) United States Patent
Stephan

(10) Patent No.: US 6,226,971 B1
(45) Date of Patent: May 8, 2001

(54) PROCEDURE AND APPARATUS FOR MAINTAINING A WORK STATION OF A TEXTILE MACHINE WITH THE AID OF A PROGRAMMABLE MAINTENANCE DEVICE

(75) Inventor: Adalbert Stephan, Beilngries (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/315,070

(22) Filed: May 19, 1999

(30) Foreign Application Priority Data

May 20, 1998 (DE) ..... 198 22 623

(51) Int. Cl.[7] ..... D01H 13/26; D01H 15/13; B65H 54/26; B65H 69/00; B65H 63/00

(52) U.S. Cl. ..... 57/264; 57/263; 57/266

(58) Field of Search ..... 57/263, 264, 265, 57/266

(56) References Cited

U.S. PATENT DOCUMENTS

| | | | | |
|---|---|---|---|---|
| 4,685,283 | * | 8/1987 | Slavik et al. | 57/263 |
| 4,773,606 | | 9/1988 | Ohashi . | |
| 4,817,381 | | 4/1989 | Meissner . | |
| 4,823,544 | * | 4/1989 | Igel | 57/265 |
| 4,840,022 | * | 6/1989 | Karl et al. | 57/263 |
| 5,065,949 | | 11/1991 | Tone . | |

FOREIGN PATENT DOCUMENTS

| | | |
|---|---|---|
| 2454721C2 | 5/1976 | (DE) . |
| 2502426 | 7/1976 | (DE) . |

* cited by examiner

*Primary Examiner*—John J. Calvert
*Assistant Examiner*—Shaun R Hurley
(74) *Attorney, Agent, or Firm*—Dority & Manning

(57) ABSTRACT

In regard to maintenance services at work station, which is located within the maintenance area of a programmable maintenance device along a plurality of similar work stations, attempts of the same maintenance, which have failed at various work stations have been counted. After reaching a specified number of similar failed maintenance procedures, at various work stations (10, 10*a*, 10*b*, 10*c*) a preset function, for instance an alarm, is released. On the other hand, where successful maintenance procedures have been executed, the numbering of the failed attempts reverts to the zero point.

22 Claims, 3 Drawing Sheets

PROCEDURE AND APPARATUS FOR MAINTAINING A WORK STATION OF A TEXTILE MACHINE WITH THE AID OF A PROGRAMMABLE MAINTENANCE DEVICE

BACKGROUND OF THE INVENTION

The present invention concerns a procedure for maintenance of work stations within a maintenance zone of a textile machine as well as a device for the execution of the procedure.

At a work station of an open-end spinning machine served by a programmable maintenance device, it is possible that the spinning-start or some other operation which requires maintenance cannot respond to the maintenance. In this case, in practice it is customary that, within the operational zone appointed to the programmable maintenance device, where the zone is comprised of a plurality of like work positions, the programmable maintenance device ends its attempts at spinning-start or other endeavor. When this is done, a corresponding command is input to the control apparatus of the maintenance device. The work station so involved is thereby marked in an identifying manner, while a signal emitter of this station is activated. In this case, optical, acoustic or even mechanical signals may be activated, which come to the attention of a maintenance person. These signals may also be interrogated by a seeking maintenance device patrolling its assigned work zone. This device, with the co-action of the control apparatus, so acts that the work station involved is excluded from the next maintenance attempt.

Experience has shown, however, that in spite of these measures, the matter can come to a multiplicity of failure attempts, particularly, when the cause for the failed attempts at spinning-start efforts is not to be found in the work station at all, but rather is within the maintenance device itself.

OBJECTS AND SUMMARY OF THE INVENTION

A principle object of the present invention is to create a procedure and a device, which helps avoided further failed attempts independent of the kind of maintenance ascribed to the maintenance device.

Additional objects and advantages of the invention will be set forth in part in the following description or may be obvious from the description, or may be learned through practice of the invention.

This purpose can be achieved in accord with the invention by means of a procedure for maintenance of like work stations within a maintenance zone of a textile machine with the aid of a programmable maintenance device. Attempts at like maintenance, which fail at various work stations are counted. After reaching a specified number of failed attempts at maintenance, a preset function is initiated. In the case of successful maintenance procedures of this kind, the numbering of the failed maintenance attempts is reset to a zero point. Since not only the failed maintenance attempts are to be counted at one individual work station, but, moreover, the determination must be made as to whether or not the failures of like maintenance attempts, which are carried out at various work stations, are repetitive. When this is known, the decision can be made that the cause of failure lies not at the work position but in the maintenance device. In this interest, a preliminary determination of maintenance attempts at one and the same work station can be executed, before this station is abandoned and the maintenance attempt finally classified as a failure.

In accordance with the invention, it is advantageous if the count is carried out so that different types of maintenance attempts are counted separately, while the deletion of the various count totals are manually effected.

Expediently, the procedure in accord with the invention is further developed so that a preset function is only initiated after, in a succession of maintenance attempts, at least three different work positions have been classified as failed. In this way, the possibility is excluded that the preset function is immediately activated, when two successfully maintained work stations by chance have registered themselves as non-maintenance compliant, although it is not the maintenance device at fault, but rather the cause is to be found in the work stations which are being maintained.

In accord with a simple extension of the procedure, an acoustic or optical alarm is released to advise a maintenance person of the occurring failure.

Since a fault occurring in the maintenance device is not to be easily dispensed, it is expedient if the maintenance device in question relinquishes its usual zone of operation and reports to a repair station. Advantageously, at the same time, the assigned zone of operation of a neighboring maintenance device is enlarged by adding the abandoned operational zone, so that in this zone as well, a routinely correctable work stoppage can be ended.

Of special advantage is a development of the procedure to initiate a fault-analyzing program, since, in this way, the underlying cause for the failure of maintenance procedures is ascertained and the correction of the fault can be carried out with specific knowledge.

If the development shows, that previously occurring maintenance faults are to be ascribed to the maintenance device and not to the work station, then it is advantageous if previous classifications of the work stations as non-maintenance compliant are deleted. These work stations can be reclassified as being operable. Thus, the work stations are not deprived of services by another maintenance device nor deprived of the services of the original maintenance devices once they have been examined and returned to operation.

For the execution of the procedure, an apparatus for maintenance from within a maintenance zone of like work stations located in a textile machine with the help of a programmable maintenance device is provided. At the reaching of a specified threshold value with the aid of the various counting, adjustment and retro-setting devices on the apparatus, there can be an initiation of the ending of the maintenance work of the unsatisfactorily operating maintenance device as well as an initiation of a function by which a quick repair time of the maintenance device can be brought about. In order to avoid a chance classification of a work station as faulty, i.e., non-maintenance compliant, an additional counter, which counts like, sequential, failed maintenance attempts, is advantageous.

A checkout of the functional ability of a maintenance device should only be undertaken, after it has shown itself to be incapacitated in maintenance operations in the case of several, maintained, work stations which sequentially follow each other.

On these grounds, it is practical to provide a setting instrument for the determination of the state of the sequential work stations, which have been registered as non-maintenance compliant.

If the maintenance device is adaptable to the carrying out of various kinds of maintenance, then it is advantageous to provide for each type of maintenance work a separate counter (inclusive of input and back-setting apparatus) which advantageously can be set back.

In accord with a simple design of the device of the invention, an alarm apparatus is provided.

Advantageously, the device can be, within the framework of the invention, since the maintenance device in the repair station is particularly easily available for the repair to be carried out.

On such occasions, when the operator is made aware of a functional failure of the maintenance device by an alarm apparatus, or when other reasons show a need for the maintenance device to be checked, it is advantageous, if a call-out means for the maintenance device is provided. This device and its associated function can also operate, independently of the pending described steps of the stated procedure, and thus possesses a self-sufficient characteristic.

So that the work stations, which are abandoned by removal from service of the assigned maintenance device from its normal operating zone, may continue to be maintained as before, a control apparatus connected to limiting apparatuses is provided.

By means of a development of control apparatus, the repair of the faulty maintenance device is made more convenient for the repair person.

The procedure and the apparatus, in accord with the present invention, enable in a simple manner the differentiation of faults, which have their cause in a work station, from those faults which are attributable to functional failure of the maintenance device.

By these described means, a reduction can be brought about to reach the absolute, required minimum of downtime, as well as stress appearances on the surface of spools, the latter, for instance, causing a spinning-start to fail. Also, the described means can reduce unnecessary wear of such elements which, in the case of spinning-start or on other types of maintenance, are placed in motion, or operate together with other components.

Embodiment examples of the invention are detailed in the following with the help of drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 2:
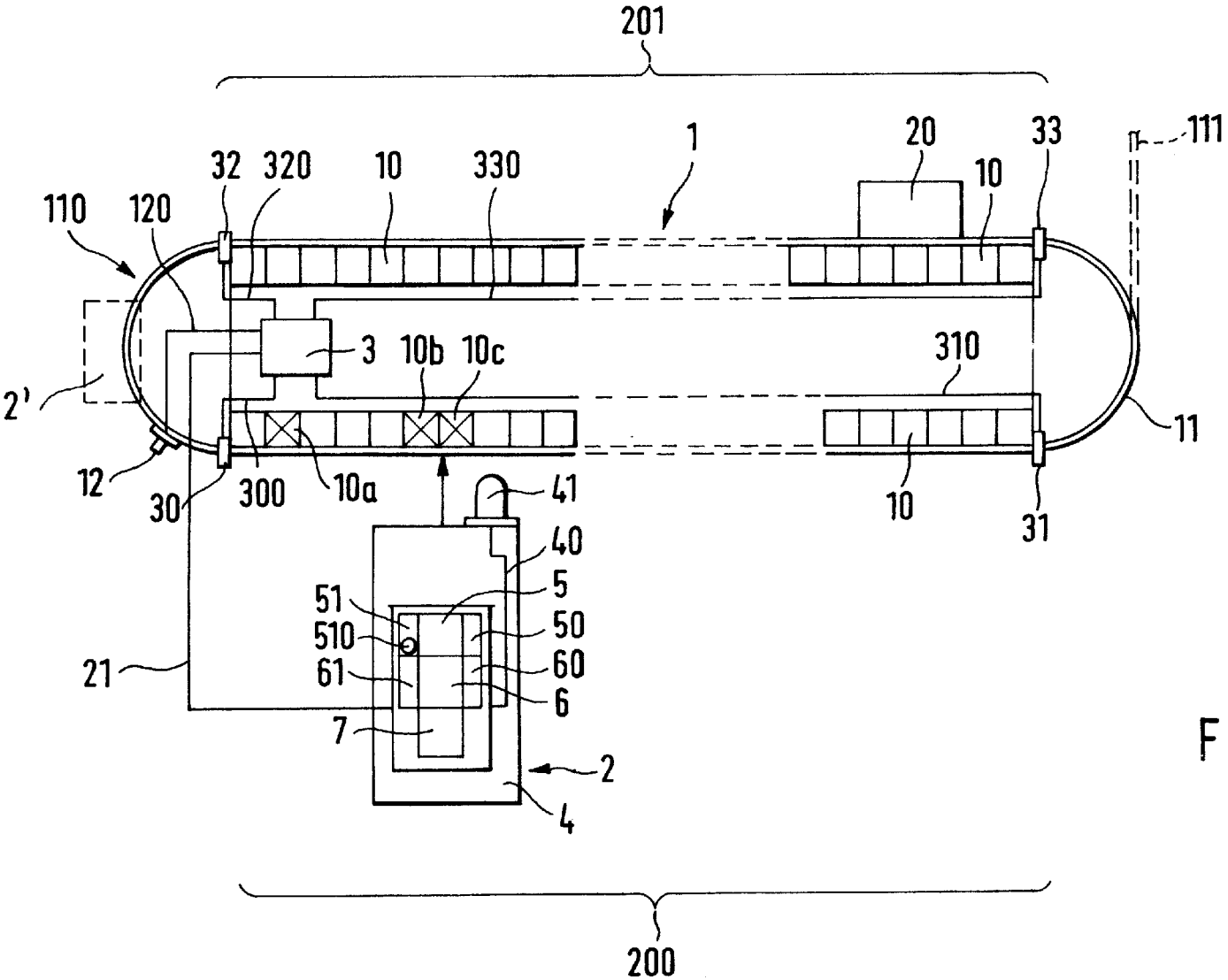
FIG. 2 shows in schematic fashion, an open end spinning machine and two cooperating maintenance devices in accord with the invention.

First, the equipment necessary for the execution of the procedure is described, with the help of FIG. 2. Principally, this procedure can be employed on different kinds of textile machines, which possess a plurality of adjacently arranged work stations, which, are maintained with the help of a patrolling maintenance device. In this manner, there can be maintained within the framework of such a procedure, for instance, winding machines or spinning machines. Spinning machines may include ring spinning machines, wrapping spinning machines, or open-end spinning machines.

For the following description, as an embodiment example, there has been chosen an open-end spinning machine 1 with a plurality of like work stations 10 on each longitudinal side. Spinning machine 1 can be a rotor spinning device, an electrostatically operating open-end spinning machine, an air spinner, a friction spinner machine, or also an open-end spinning machine which operates on a different principle. Corresponding to need, the work stations can be differently designed.

The open-end spinning machine 1 supports a rail 11, which runs around the entire machine and carries programmable maintenance devices 2, 20. Each maintenance device 2 and 20 has been assigned its own operational zone 200 or 201, which, in the case of the shown embodiment, corresponds to one side of the machine.

Principally, to aid ease of reading of the following description, the maintenance device 2 is presented in a more detailed manner than maintenance device 20, although it is self evident that the two maintenance devices 2 and 20 are designed in an identical manner.

The open-end spinning machine 1 exhibits a central control apparatus 3, which is controllingly connected by a line 21 with an additional control apparatus 4 on the maintenance device 2, 20. Moreover, the central control apparatus 3, with the help of lines 300, 310 is controllingly connected to apparatuses 30, 31 for the limiting of the operating zone 200 of the maintenance device 2. Central control apparatus 3 is also controllingly connected with the help of lines 320, 330 to apparatuses 32, 33 for the similar limiting of the operating zone 201 of the maintenance device 20. Thus, the maintenance device 2 patrols back and forth between the apparatuses 30 and 31, and the maintenance device 20 patrols back and forth between the apparatuses 32 and 33.

The control apparatus 4 of the two maintenance devices 2 and 20 possesses a counter 5 with an adjustment device 50. With this adjustment device 50, a number of maintenance attempts is input. This number represents a limit of attempts to be carried out sequentially without result at various work stations 10. After this number has been attained, then there will be excluded from further maintenance attempts, not only these stations 10, which have shown themselves as non-maintenance compliant, but also other work stations 10.

A set-back device 51 is added to the counter 5.

In accord with FIG. 2, a signal or alarm 41 (for instance in the form of a light) is connected with the control apparatus 4 of the maintenance device 2.

For the maintenance of a work station 10, the elements in use on the open-end spinning machine 1 as well as on the maintenance device 2, 20 are well known. Thus, for the sake of clarity of drawings as well as description, the pictorial representation and detailed explanation thereof is dispensed with.

Figure 1:
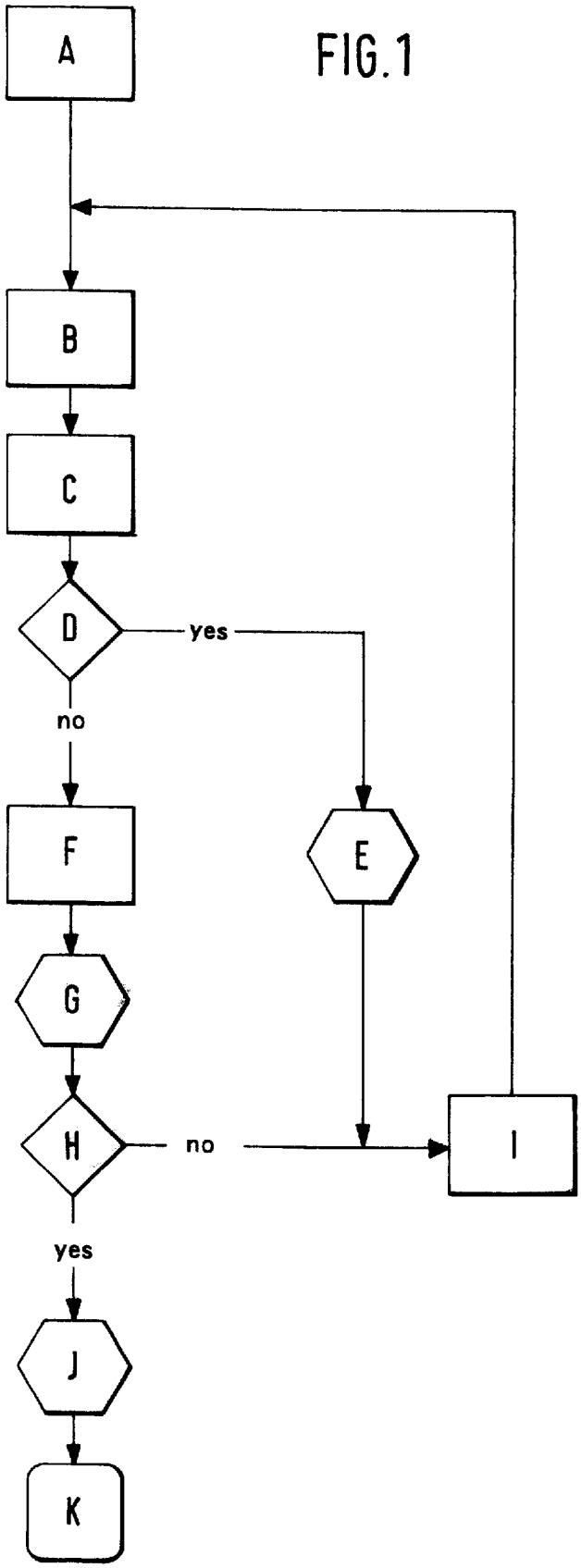
FIG. 1 shows the procedure of the invention in a flow-diagram.

Since the equipment has been described as to its construction, now a first embodiment example of the procedure should be explained with the aid of the FIGS. 1, 2.

In FIG. 2, three work stations, 10*a*, 10*b* and 10*c* have been designated by the addition of a cross, since, for the following description, it is being assumed that on these three work stations, 10*a*, 10*b* and 10*c*, the same maintenance operations are to be performed, for instance, a spool change with the subsequent spinning-start which is therewith connected.

The necessity of such a maintenance operation is announced to the maintenance device 2 as a disturbance (refer to A in FIG. 1). Based on this announcement, the patrolling maintenance device 2, is caused to stop at this work station (see B), when the maintenance device would otherwise pass by. The maintenance device 2 now executes the maintenance in a known appropriate manner (see C), that is, makes the spool exchange as an example. As soon as this is completed, interrogation is made as to whether or not the maintenance has been successful (see D). The state of success or failure is determined by optical or mechanical monitors and/or terminal limit switches. If the maintenance procedure has been properly carried through (see "yes" by the symbol D=D/yes), then a feedback impulse is sent to the reset apparatus 51 for counter 5 (see E) in order to set the counter 5 back to the zero point, unless said counter is already in this zero position. At this point, the progress of the maintenance device 2 is released to the next work station 10*b* (see I) where the maintenance device 2 is brought to a stop (B), in order to start a new maintenance cycle.

However, if the maintenance cycle at the work station 10 was not successful (D/no), then this work station 10*a* is classified as non-maintenance compliant and the maintenance effort declared failed (F). This state of the system is then appropriately stored in memory, so that the maintenance device 2, upon a later passage by this open-end station 10*a* does not make a stop, but leaves the station without attention.

Besides this, the stored number in the counter 5 is increased by the value of "1" (see G). If, then, upon a comparison with the threshold value stored in the counter 5, for instance this being "3", it turns out (H) that the threshold is not yet reached, (H/no) then the maintenance device 2 is given the command for carrying on (I).

The maintenance device 2 then proceeds with its patrolling movement within the operating zone 200 along the open end spinning machine 1, until it comes to the next work station, 10*b*, to be maintained. A stop is made here (B) in order to execute the necessary maintenance operation (C).

Had it turned out, that at (H) the threshold value had been reached (H/yes), (that is, after a non-productive maintenance attempt at the third cross-marked work station 10*c*), then, with the aid of the reset apparatus 51, the count of the counter 5 is set back to the zero point (J). Subsequently, a function is initiated (K), in accord with which, according to FIG. 2, an alarm (41) is activated.

In the case of complex operations, which are to be carried out by the maintenance device on a work station 10, 10*a*, 10*b*, 10*c*, for instance, upon the exchange of a full spool for an empty bobbin with its concurrent spinning-start procedure, there are many possibilities for a failing function of the maintenance device 2. On this basis, it is advantageous if the maintenance device 2, after reaching the preprogrammed number limit in the counter 5, is taken out of its operating zone 200 and brought into a repair station 110 (FIG. 2). Here, the maintenance device 2 can be monitored without compromising the accessibility to the work stations 10 (see the dotted representation of a maintenance device 2'). So that the operating person does not have to bring the maintenance device 2 manually into the repair station 110, this repair station can be provided with a call-out device 12 (call button, or the like), which, by means of a line 120, is in communication with the control apparatus 3. Upon activation of this call-out device 12, the control apparatus 3 emits a command to the control apparatus 4 of the maintenance device 2, upon the grounds of which the maintenance device 2 runs itself into the repair station 110. Alternatively, it is, however, possible, that the control apparatus 4 as function (K) does not only activate the switching-on of the alarm apparatus 41 in the form of a light or even an acoustic alarm emitter (not shown), but also initiates the automatic bringing of the maintenance device 2 into the repair station 110.

Likewise, alternatively, or additionally, a call-out device can be located on the maintenance device 2 and/or also in the operation zone 200. Thereby, it is possible for the operating person to send the maintenance 2 into the repair station 110, without that person having to go there. This formulation of the invention is particularly of advantage, since modern spinning machines are very long and the operating person thus saves time, and furthermore, avoids the considerable personal force needed for the manual transfer of the maintenance device itself.

As the above description clearly shows, the work stations 10*a*, 10*b*, 10*c* . . . or other work stations within the work zone 200 served by the same assigned maintenance device 2, simply and constantly are counted with the counter 5, so that it is clearly determined which maintenance device 2 has operated falsely.

Either the manual or the automatic placement of the maintenance device 2, which is impaired in functioning, can have the result that the apparatus 30 between the operational zone 200 and the repair station 110 is temporarily placed out of service, so that the maintenance device 2 can exit from its customary operational zone. Likewise, when the maintenance device 20 should be brought into the repair station 110, the apparatus 32 must be temporarily inactivated.

When the maintenance device 2 has left its operational zone 200, then the apparatus 30 is again placed in its normal setting so that the operational zone 200 is thereby renewed in the direction toward the repair station 110. The operational zone 200 is, however, now left abandoned. In order to avoid this, the control of 30, 32 can be enhanced.

The apparatuses 30, 31, 32, 33 are, in accord with FIG. 2, indeed shown as mechanical detents, but they can also operate without physical contact (light relay or the like).

Again, the apparatuses can be substituted by a single arrangement in the form of a control program.

Independent of the design of these apparatuses 30, 31, 32, 33, that is, of the program replacing these apparatuses 30, 31, 32, 33, the activation of the call-out device 12 can so operate that the control apparatus 3 incapacitates the apparatuses 31 and 33. The result is that the maintenance device 20, now, instead of its customary operational zone 201, additionally takes on the abandoned operational zone 200. This function (K) can also be initiated by the control device 4, when it controls the bringing of the maintenance device 2 into the repair station 110.

When a maintenance device 2, 20, relinquishes an operational zone 200, or even an extended operational zone 200 plus 201, the stored number in the counter 5 will be deleted, or released for manual deletion. As will be explained later, each time when a maintenance device 2, 20, takes over a maintenance zone 200, 201, it will do so with the counter starting from the zero point. Starting from the zero point allows very exact determinations to be made as to which maintenance device 2, 20 has improperly functioned. Erroneous misidentification is thereby excluded.

Both the procedure as well as the equipment can be modified in a multiplicity of ways within the framework of the present invention. For example, individual or all features might be replaced by equivalents, or find use in different applications. Thus, it is not necessary that, for the longitudinal side of each machine, a separate maintenance device 2, 20 be provided. Much more, several open-end spinning machines 1 can be connected to one another by means of rails, so that a maintenance device 2, 20 upon need can even transfer from one open-end spinning machine 1 to another. Correspondingly, there are devices for the limiting of the operational zones 200, 201 . . . provided for the travel of the maintenance devices 2, 20 . . . . This system can also find application, when the open-end spinning machine 1 simply has work stations 10 along one of its longitudinal sides, while the other machine side, for instance, is dedicated to the preparation of fiber band filled cans.

Instead of a spool exchange with subsequent spinning-start, other maintenance work can be foreseen, which can be monitored in the same way.

Thus, from time to time, it is possible to exchange, with the help of the maintenance device 2, 20 . . . , for instance, the spin rotor (not shown) or another kind of designed element, such as a thread removal tube, a shredding roll, or the like, for a new element, in order to suit the corresponding needs of other thread materials to be processed. Further, other applications made possible can include monitoring materials of different spinning qualities or simply checking on the spin rotors or other elements outside of the open-end spinning machine 1 and, if necessary taking corrective measures thereon.

In accord with the type of the maintenance work which is to be carried out, it can be advantageous to repeat a failed maintenance procedure several times. Such a case is given consideration in the flow diagram of FIG. 3. In order to be able to operate in accord with this diagram, the maintenance device 2 must exhibit, besides the counter 5 for each kind of maintenance that can be carried out by the maintenance device 2, 20, additional counters 6 respectively . . . (FIG. 2) with an adjustment device 60 . . . and a set-back device 61 . . . . By this means, with the aid of the adjustment device 60, each number of maintenance attempts taken per work station 10 is determined before this work station was declared non-maintenance compliant and the maintenance attempt defined as failed.

Figure 3:
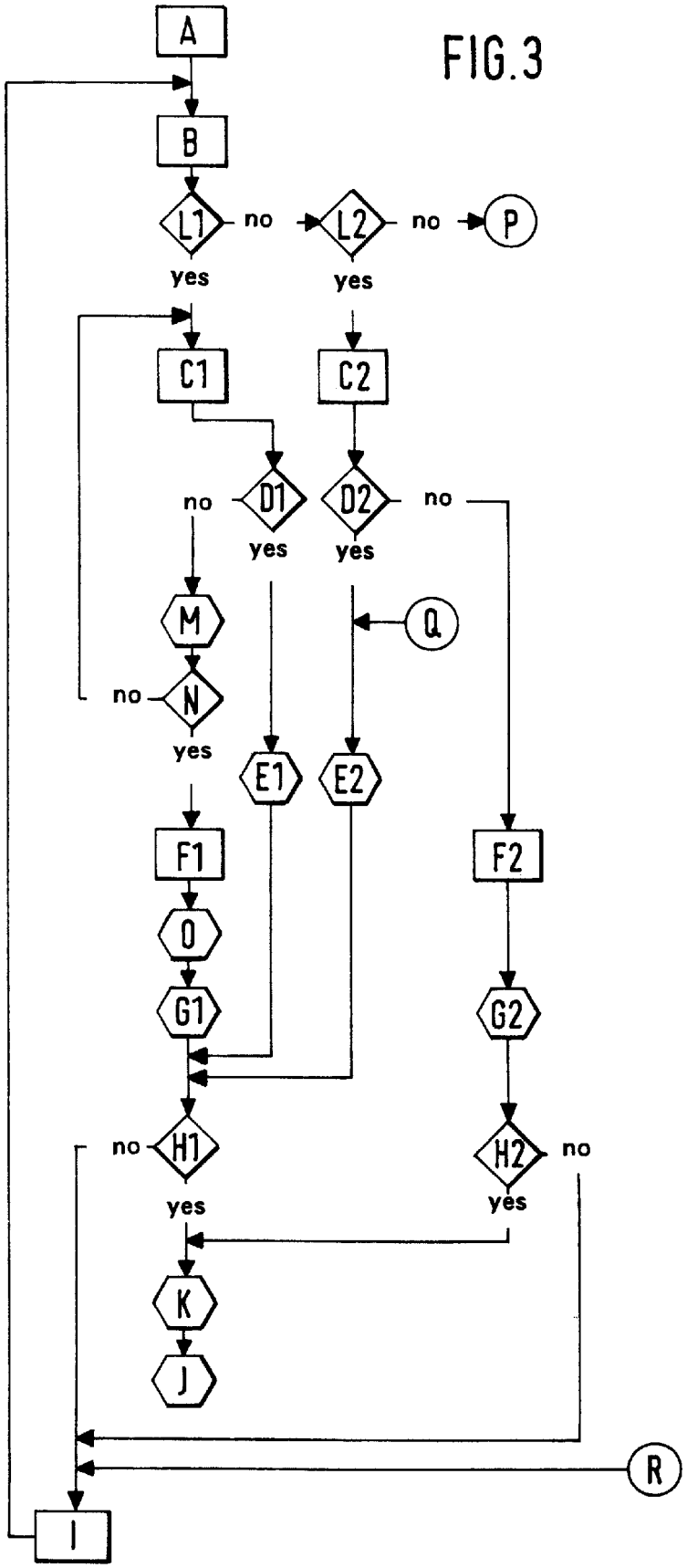
FIG. 3 shows a modification of the procedure in accord with the invention in flow-diagrammatic form.

FIG. 3 shows a first type of maintenance, which is designated in the flow diagram with a "C1". In this case, the concern is, for example, in regard to a conventional spinning-start following a thread break independent from a spool exchange.

A second type of maintenance, is designated on the flow diagram of FIG. 3 with a "C2". This "C2" type of maintenance can be the previously described spool exchange in combination with a subsequent spinning-start, wherein this spinning-start procedure is executed in conventional manner, partially with other elements that are employed in a spinning-start after a thread breakage. In carrying out this particular maintenance, the situation can be, that the spool exchange fails, so that a subsequent spinning-start procedure cannot be undertaken.

A repetition of the spool exchange has, as a rule, little point, because otherwise, under certain circumstances, the empty bobbin on the transport band (not shown) is picked up at the removal of full spools and then, can be collected along with full spools. If the spool exchange did succeed, but the associated spinning-start did not, then, without a repetitive execution of the spool exchange, a repeat of the spinning-start would be of advantage. Although it is entirely possible to simply make repeated attempts at a spinning-start which is subsequent to the now abandoned spool exchange, such a possibility is, however, not shown in the flow diagram of FIG. 3.

Moreover, further types of maintenance can be foreseen, for instance, the already mentioned exchange of a spinning element (spinning rotor, thread removal tube, shredding roll, etc.), which are indicated in the flow diagram of FIG. 3 by the symbols (connection nodes) P, Q and R.

Upon the announcement of a disturbance, (A in FIG. 3), the maintenance device 2 in the course of its patrol trip, stops at the work station, for instance, at the work station 10*a* (B). Now the signal is given as to which maintenance operation is to be carried out. The kind of the maintenance to be executed is signaled to the maintenance device 2 in a known manner along with the disturbance. Then, interrogation is made as to whether or not the first maintenance procedure is to be performed (L1) (for instance, spinning-start after break in thread). In case the reply is "yes" (L1/yes), then this maintenance procedure is carried out (C1).

If the spinning-start (D1/yes) succeeds, the set-back impulse for the counter 5 is activated (E1). Next, also the counter 6, with which faulty spinning-start attempts are counted, is set at the zero point with the help of the set-back device 61, if it is not already at this value (see P). Subsequently, a determination is made, whether or not the pre-input number of faulty maintenance efforts at work stations 10 has already been reached. (see H1). Since the previously carried out spinning-start was successful and the counter 6 is accordingly reset to zero, then this number has not yet been reached (H1/no).

At this point, the maintenance device 2 signals that it can travel further to the next work station which requires maintenance (see I), where it carries out another spinning-start cycle.

If, in the case of the monitoring after a completed spinning-start (see C1), the failure of a thread is determined (D1/no), then the counter 6 for the registration of the faultily executed spinning-starts is increased by the value "1" (M). Now, interrogation is made as to whether or not the pre input number of spinning-start attempts is already reached (N). For instance, by the counter 6 for the number of the executed spinning-starts, the number "3" was pre set. After the first faulty spinning start attempt, this threshold value is not yet reached (N/no). Therefore, the maintenance program carries on its operation at the work-step C1 (renewed spinning-start attempt). Once again, attempt, the above described work-steps D1, E1, H1, and I are carried out in the case of successful such attempts. In the case of failed attempts, C1 is activated anew.

If the spinning-start does not succeed by a third attempt, then the determination (N/yes) is made that the pre-input number 3 of spinning-start attempts has been reached. On this basis, this work station 10*a* is classified as non-maintenance compliant (F1). Then the counter 6 with the set-back device 61 is returned to the zero point (O). In addition, a counting impulse is sent to the counter 5, so that the residing total is increased by the value of "1" (G1). Now the interrogation is made, with the aid of the adjustment device 50, as to whether or not the pre-input number of faultily maintained work stations 10 is attained (H1). If this is not the case, (H1/no) then the maintenance device 2 continues on its patrol (see I) toward another work station (10*b*) in order to carry out the called-for maintenance operations. The maintenance device 2 halts in front of the currently involved work station 10*b* (B) and carries out the described cycle anew. If the spinning start fails again three times (the threshold input into counter 6), then the value in the counter 5 is increased by "1", so that this value now reaches the level "2".

If the spinning-start does not succeed in a sequence (wherein executed maintenance operations of other kinds is not considered) by a third attempt at work station 10*c*, then the threshold value of "3" of the counter 5 has been reached (H1/yes). The counter 5 is now (in accord with FIG. 1), with the help of the set-back device 51, returned to the zero point (J). Subsequently a function is initiated (see K), while, for instance, the alarm apparatus 41 in the form of a light is turned on and/or an acoustic alarm is sounded and/or the maintenance device 2 is run into the repair station 110. The reversed sequence of the steps J and K, which is shown in FIG. 3, will be explained later.

If the interrogation at L1 is answered by "no", then a maintenance operation of a second or further kind of maintenance is to be carried out, which is to be determined by the additional interrogation L2 (yes/no). Further interrogations of this kind (not shown) can be provided for, unless on the program associated with the connection point P, simply a third type of maintenance, is permitted only as a final possibility.

If a maintenance operation of the second type of maintenance is to be carried out, without the expectation of repetition, then the further course of the work corresponds to that which was described above with the help of FIG. 1. Simply for a better differentiation of the course of the work, the characteristic letters therefor are expanded by an index for the designation of the type of maintenance (first type maintenance or second type of maintenance).

Beyond this, in accord with FIG. 3, connection nodes Q and R are foreseen for a third type of maintenance. In this matter, "Q" stands as the symbol for a connection into the "yes" exit of one of the program steps corresponding to the program step D2 of such a third type of program, while the symbol "R" stands for a connection with the "no" exit of a program step corresponding to the program step H2 of such a third kind of program. Other programs of further, not shown or mentioned types of maintenance can, in an analogous manner, be connected parallel to the connections to the nodes Q and R with the shown program between the program steps D2 and E2, or, H1 and I. At the node P, further interrogation analogous to the interrogations L1 and L2 can be connected.

The further types of maintenance can correspond to that indicated program in FIG. 1 with the symbols C1 to H1, if several maintenance attempts before a break-off of the efforts can be carried out. On the other hand, the further types of maintenance can correspond to that program indicated by the symbols C2 to H2, if, a repeat of the corresponding maintenance program is to be dispensed with. Further modifications are possible, such as, for instance, previously explained in regard to the combined spool exchange/spinning-start program. Such modifications would required corresponding customizing of the given programs to suit their requirements.

Previously, the number "3" was mentioned as an example, for work stations 10, by which the maintenance attempts were classified as failed. This value can, in principle, be optionally made a fixed value. The threshold count should, as a rule, reach at least the general value of "3", in order to rule out chance results. Other wise, threshold values which are too high, for instance above "10" are not be recommended because of the avoidable stress of the aggregates and parts which are subject to the maintenance attempts.

By the consideration of the maintenance attempts on several open end spinning stations 10, errors are excluded on the work stations 10, or, at least the fact is made certain, that the work station 10 does not have to be considered the single source of error causes. Thus, it is also possible, in the framework of the releasing function K, to foresee that the work stations 10, 10*a*, 10*b*, 10*c* are once again ascertained to be classified as maintenance compliant, since their previous classification in connection with a series of maintenance attempts led to the removal from service of the maintenance device 2, 20.

Other counters, which for other purposes or further types of maintenance programs are required or desired, remain in the presentations without consideration. So, for each additional kind of maintenance operation, individual counters 5, 6, . . . wit corresponding adjustment devices 50, 60 . . . and corresponding set-back devices 51, 61 . . . are provided.

With each of these counters, 5, 6, . . . , the maintenance attempts which have been classified as failed maintenance attempts are enumerated separately according to the kind of maintenance. This separate enumeration later allows determination of the kind of the maintenance which has not permitted itself be carried out.

Thus, it can be advantageous if the counters 5, 6, . . . for the maintenance efforts classified into the "failed" category are not automatically reset, but the input threshold values therein remain there until they are expunged manually by the operating person, when this person monitors the maintenance device 2. In this way, the attention of the operating person is directed to those elements, which are necessary for the execution of the faulty maintenance. To this purpose, in accord with FIG. 2, an activation button 510 is provided for the reset device 51. In such a case, the program steps J and K are carried out in reversed sequence. The setting back of the counter 5 (Symbol J) is effected by means of the operating person, after this person, by the activation of the function K (see FIG. 3), has been advised in regard to the error prone nature of the maintenance device 2.

In addition to the measure that the counters 5, 6 . . . , when set back, can only be actuated manually, the control apparatus 3 can possess an apparatus 7 for the carrying out of a function-analysis (fault finding-program). Upon the carrying out of each maintenance program (C, C1, C2 . . . ), each step of this procedure is monitored, that is, one or more phases thereof (for instance, the presence or non-presence of a thread). As soon as a deviation from the norm occurs, this is registered by the control apparatus 4 and/or the control apparatus 3 and stored. Then by button activation, the deviations are exhibited at the desired time in an appropriate way.

In accord with the design of the work station (as a part of a spool machine, a ring spinning machine, a winding spinning machine, or an open-end spinning machine, each of which moreover, can in turn be designed in various ways, or found as a component of still another machine, or textile machines with a multiplicity of similar work stations), the maintenance operations to be carried out in these cases have to be likewise of various kinds.

The above description, selected for an embodiment example, is thus in no way to be interpreted as a limitation. Since, independent of the kind of maintenance, the common principle is present that, by the accumulation and repetition of faults of the same kinds, at various work stations 10, 10*a*, 10*b*, 10*c* which are served by the same maintenance device 2, the conclusion must be drawn, that the causes of failures is to be sought in the maintenance device 2, 20, which is suited to the application to which it is assigned.

It will be appreciated by those skilled in the art that various modifications any variations can be made in the present invention without departing from the scope of the invention. It is intended that the present invention include such modifications and variations as come within the scope of the appended claims and their equivalents.

What is claimed is:

1. A process for monitoring maintenance operations performed by a programmable maintenance device on work stations within an operational zone of a textile machine, the process comprising:

setting a specified number for like failed maintenance attempts to be performed in succession by the programmable maintenance device to determine the presence of faults occurring with the programmable maintenance device;

performing maintenance attempts by the programmable maintenance device on work stations within the textile machine which require the designated maintenance;

counting like failed maintenance attempts performed by the programmable maintenance device on work stations;

initiating a preset response function for the programmable maintenance device after the specified number of failed maintenance attempts by the programmable maintenance device has been reached; and resetting the number of failed maintenance attempts to a zero point if a successful like maintenance attempt is accomplished before the specified number of failed maintenance attempts has been reached, which initiates the preset response function.

2. A process as in claim 1, further comprising engaging in a specified number of maintenance tries by the programmable maintenance device at a work station before the maintenance attempt is classified as failed and the work station is classified as non-maintenance compliant.

3. A process as in claim 1, wherein different types of maintenance attempts are counted separately.

4. A process as in claim 1, further comprising storing the counted maintenance attempts until manual deletion is performed.

5. A process as in claim 1, wherein the preset response function is only initiated after at least 3 different work stations have been classified as non-maintenance compliant.

6. A process as in claim 1, wherein the preset response function is an alarm.

7. A process as in claim 1, wherein the preset response function is the removal of the programmable maintenance device from its assigned operational zone into a repair station.

8. A process as in claim 7, further comprising assigning the maintenance zone of the removed programmable maintenance device to another programmable maintenance device patrolling a neighboring operational zone.

9. A process as in claim 8, wherein the preset response function is an alarm and the removal of the programmable maintenance device from its assigned operational zone into a repair station.

10. A process as in claim 8, wherein the preset response function is a fault analyzing program.

11. A process as in claim 2, further comprising reversing the classification of non-maintenance compliant of the work stations that led to the initiation of the preset response function upon execution of the preset response function.

12. An apparatus for monitoring maintenance performed by a programmable maintenance device on work stations within an operational zone of a textile machine, said apparatus comprising:

at least one first counter for counting like failed maintenance attempts performed by said programmable maintenance device on said work stations;

a setting instrument for establishing a specified number of like failed maintenance attempts performed by said programmable maintenance device to be counted by said first counter;

a first control apparatus for initiating a preset response function once said first counter reaches said specified number of like failed maintenance attempts performed by said programmable maintenance device; and a reset mechanism for resetting said first counter to a zero point upon a successful like maintenance attempt being accomplished before said first counter reaches said specified number of like failed maintenance attempts.

13. An apparatus as in claim 12, further comprising at least one second counter to count a specified number of maintenance tries by said programmable maintenance device at a single work station before a maintenance attempt is classified as failed and said work station is classified as non-maintenance compliant.

14. An apparatus as in claim 13, wherein said second counter forwards a counting impulse signal to said first counter for counting like failed maintenance attempts.

15. An apparatus as in claim 13, wherein each type of maintenance operation performed by said programmable maintenance device is monitored by a separate said first counter.

16. An apparatus as in claim 15, wherein each said first counter can be manually reset.

17. An apparatus as in claim 13, further comprising an alarm connected to said first control apparatus, wherein said first control apparatus activates said alarm as said preset response function.

18. An apparatus as in claim 12, further comprising a second control apparatus which in conjunction with said first control apparatus allows removal of said programmable maintenance device from said operational zone into a repair station once said preset response function is activated.

19. An apparatus as in claim 18, further comprising a call apparatus connected to said first control apparatus, wherein said first control apparatus activates said call apparatus to automatically remove said programmable maintenance device from said operational zone into said repair station.

20. An apparatus as in claim 19, further comprising limiting apparatuses defining said operational zone, wherein said limiting apparatuses are controlled by said second control apparatus.

21. An apparatus as in claim 20, wherein said second control apparatus allows said programmable maintenance device to be removed to said repair station and allows expansion of an operational zone of a neighboring programmable maintenance device to include said operational zone of said programmable maintenance device.

22. An apparatus as in claim 18, wherein said first control apparatus exhibits a device for execution of a functional analysis of said programmable maintenance device.

* * * * *